US005871386A

United States Patent [19]

Bart et al.

[11] Patent Number: 5,871,386

[45] Date of Patent: Feb. 16, 1999

[54] REMOTE CONTROLLED MOVABLE BALL AMUSEMENT DEVICE

[75] Inventors: Philip D. Bart, Pompano Beach, Fla.; William T. Wilkinson, P.O. Box 73, Salem, N.J. 08079

[73] Assignee: William T. Wilkinson, Ft. Lauderdale, Fla.

[21] Appl. No.: 900,950

[22] Filed: Jul. 25, 1997

[51] Int. Cl.[6] ..... A63H 17/36; A63H 29/00; A63H 30/04

[52] U.S. Cl. ..... 446/460; 446/443; 446/456

[58] Field of Search ..... 446/443, 454, 446/456, 457, 458, 460, 462, 465

[56] References Cited

U.S. PATENT DOCUMENTS

| | | | |
|---|---|---|---|
| 2,104,636 | 1/1938 | Burcham . | |
| 2,277,057 | 3/1942 | Bach . | |
| 2,949,697 | 8/1960 | Licitis et al. . | |
| 3,102,362 | 9/1963 | Neal . | |
| 3,106,397 | 10/1963 | Lacey . | |
| 3,453,773 | 7/1969 | Compton . | |
| 3,500,579 | 3/1970 | Bryer . | |
| 3,555,475 | 1/1971 | Szcepanski . | |
| 3,621,605 | 11/1971 | Witiak | 446/454 |
| 3,667,156 | 6/1972 | Tomiyama et al. . | |
| 3,798,835 | 3/1974 | McKeehan . | |
| 3,804,411 | 4/1974 | Hendry . | |
| 3,843,125 | 10/1974 | Loose . | |
| 4,057,929 | 11/1977 | Ogawa | 446/462 |
| 4,173,096 | 11/1979 | Meyer et al. | 446/289 |
| 4,183,174 | 1/1980 | Barris et al. | 446/456 |
| 4,391,224 | 7/1983 | Alder . | |
| 4,438,588 | 3/1984 | Martin . | |
| 4,471,567 | 9/1984 | Martin . | |
| 4,501,569 | 2/1985 | Clark . | |
| 4,541,814 | 9/1985 | Martin . | |
| 4,601,675 | 7/1986 | Robinson . | |
| 4,726,800 | 2/1988 | Kobayashi . | |
| 4,737,134 | 4/1988 | Rumsey . | |
| 4,767,376 | 8/1988 | Hanzawa | 446/457 |
| 4,813,906 | 3/1989 | Matsuyama et al. . | |
| 4,822,044 | 4/1989 | Perkitny . | |
| 4,897,070 | 1/1990 | Wagstaff | 446/273 |
| 4,927,401 | 5/1990 | Sonesson . | |
| 5,066,011 | 11/1991 | Dykstra et al. . | |
| 5,072,938 | 12/1991 | Shin . | |
| 5,135,427 | 8/1992 | Suto et al. . | |
| 5,427,561 | 6/1995 | Eichhorn et al. . | |
| 5,429,543 | 7/1995 | Tilbor et al. | 446/456 |
| 5,439,408 | 8/1995 | Wilkinson . | |
| 5,533,921 | 7/1996 | Wilkinson | 446/409 |
| 5,667,420 | 9/1997 | Menow et al. | 446/433 |

FOREIGN PATENT DOCUMENTS

| | | |
|---|---|---|
| 1184170 | 10/1957 | France . |
| 8803308 | 6/1988 | Germany . |
| 6407 | 3/1914 | United Kingdom . |
| 1292441 | 10/1972 | United Kingdom . |

*Primary Examiner*—Robert A. Hafer
*Assistant Examiner*—Laura Fossum
*Attorney, Agent, or Firm*—Connolly & Hutz

[57] ABSTRACT

A remote control movable ball amusement device includes a plurality of shell parts so as to result in a non-spherical ball. Preferably each shell part is driven independently of the other. An antenna is provided which extends externally of the shell parts to increase the range of operability of the device.

40 Claims, 5 Drawing Sheets

REMOTE CONTROLLED MOVABLE BALL AMUSEMENT DEVICE

BACKGROUND OF THE INVENTION

Among the most fascinating types of amusement devices are remote controlled devices. A common form of such device is a vehicle which could be controlled from a distance either through a remote radio frequency unit or by an electrical cord. Another form of remote controlled device is a movable ball which conventionally takes the form of a sphere containing some drive mechanism actuated and controlled by a remote unit to cause the sphere to roll. A disadvantage with conventional remote controlled balls is that the range or effectiveness is generally only about 15 feet–20 feet. Additionally, it is difficult to have precise control in the direction of movement and in the stopability of the device, as well as having the ability for a wide range of speed.

SUMMARY OF THE INVENTION

An object of this invention is to provide a remote controlled movable ball amusement device which has advantages over known devices.

A further object of this invention is to provide such a remote controlled movable ball amusement device which has greater range with greater control over speed and direction.

In accordance with a preferred embodiment of this invention the remote controlled amusement device is a non-spherical ball which is formed in a plurality of parts. Preferably a separate drive mechanism is mounted in each of the parts for independent control. Thus, the speed and direction of control is enhanced.

In accordance with a further preferred embodiment of this invention an external antenna is provided on the device which functions as a wheely bar to prevent the internal mechanism inside the device from spinning. Additionally, the external antenna increases the range of effectiveness of the remote control unit.

THE DRAWINGS

DETAILED DESCRIPTION

Figure 2:
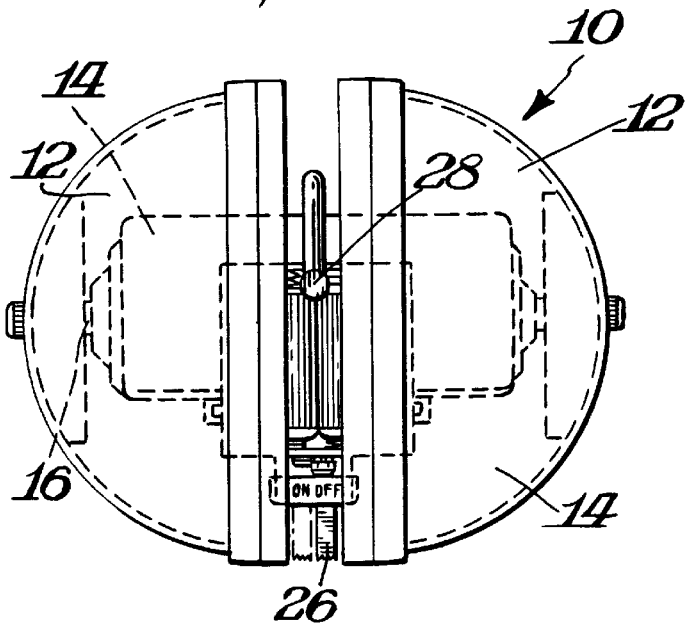
FIG. 2 is a top plan view of the device shown in FIG. 1.

The present invention, in general, relates to a toy ball that is motorized and controlled, preferably by radio or other remote mechanisms. One of the features of the ball in the preferred practices of the invention is that the ball's shell structure is formed in more than one part, preferably two parts, and that at least one of these parts is motorized. Preferably, each of the parts is motorized. This feature dramatically improves control and maneuverability of the device.

As a consequence of forming the shell in multiple parts with reversible motors it is possible to achieve a number of combinations of motion. For example, forward motion could be achieved by activating both motors in a forward direction. Backwards motion could be achieved by reversing the direction of both motors. A backwards turning motion could be achieved by having one motor reversed toward the left with no or less power given to the motor on the right or conversely, one motor reversed to the right with no power to the motor on the left. Forward turns could be achieved by having one motor move in a forward left direction with no power to the motor on the right or conversely by having one motor move forward to the right with no power to the motor on the left. A left spin/tight turn could be achieved by powering the left motor in a backward or reverse direction and the right motor in a forward direction. Conversely, a right spin/tight turn could be achieved by having the left motor powered in the forward direction and the right motor powered in the reverse or backward direction.

The ball could be powered by any suitable energy source, but preferably is battery operated since that is a conventionally acceptable manner known to users of remote controlled balls. However, the invention may be practiced using other energy sources such as air, infra-red gas, etc. The main power source for the motor could be inside or outside of the ball.

The invention, in its broad sense, may also be practiced where there is no motor and the power is provided by the user such as by a hand crank mechanism or other self power such as a plunger activated by air, water, etc.

Preferably, an externally extending antenna is provided to increase the range of effectiveness of the remote unit. Alternatively, the range of effectiveness could be increased by having an internal antenna or receiver with a pattern of holes completely through the shells to provide direct access from the transmitter to the receiver.

The shell of the ball may have any type of attraction material/structures, either permanently incorporated into the shell or on its surface or detachable from the shell such as by use of adhesive strips, rubber covers, etc.

The ball may be preferably of any shape other than a true sphere. In a preferred practice the ball is made by two hemispheres which are slightly spaced apart thereby creating a generally flat region at their juncture. The invention is preferably practiced where the ball is flattened, oval, elliptical, football shaped, pill shaped, etc. Preferably, the ends of the ball are round. Alternatively, the ball could be a true sphere.

The ball shell parts may either touch or not touch. Preferably the shell parts are joined but still rotate independently such as by a groove in track or known bearing structures. Preferably, each motor has its own shaft which extends outwardly with the two shafts being in alignment with each other. Each shell is mounted to its shaft so that by having the shafts rotate independently of each other the shells, likewise, rotate independently.

The spacing or juncture between the shells may be open or may be filled or sealed with any suitable material such as a rubber band circumscribing the ball or located at the interface.

The invention may utilize various accessories such as kits that allow the ball to be used in games such as ramps, races, etc. Reference is made to co-pending application Ser. No. 08/847,486 filed, Jun. 2, 1997 in the name of William T. Wilkinson entitled REMOTE CONTROLLED ROLLING TOY which discloses various types of games and various modifications to ball structure. All of the details of that application are incorporated herein by reference thereto.

The ball motors can be turned on or off by any means, but preferably an on/off switch is used which is readily accessible at the juncture of the two shell parts.

The ball can interact with another ball or balls to increase game possibilities and to create game situations for multiple users.

The balls can be connected by any means either permanently or detachably to create various games and different motion features. For example, two balls could be joined by two shafts, cords, rods, strings, rubber/elastic bands, wires, etc.

FIGS. 1–5 illustrate a remote controlled movable ball amusement device 10 in accordance with a preferred embodiment of this invention. As shown therein the ball 10 is of non-spherical form and its shell comprises a plurality of parts, preferably two shell halves or hemispheres 12,12. Each shell part 12 includes a suitable motor drive mechanism 14. Any known drive mechanism suitable for this invention may be used, preferably a battery operated reversible motor. Reference is made to U.S. Pat. No. 5,439,408, all of the details of which are incorporated herein by reference thereto.

Each drive mechanism includes its own shaft 16. Shafts 16,16 are coaxially aligned. Each shaft includes spline structure 18 best shown in FIG. 4. The spline structure 18 engages complementary spline structure 20 on internal support structure or ring 22 at each end of the shell part 12. To assure that engagement is maintained between the spline structures 18,20 a fastener 24 such as a bolt or screw secures the shell part 12 to the shaft 16. Thus, when each drive mechanism 14 rotates its shaft 16 the attached shell part 12 is also rotated. Since the drive mechanisms 14,14 are independent of each other the two shell parts rotate independently of each other. The rolling movement is about the horizontal axis formed by shafts 16,16.

The drive mechanisms 14,14 may be turned on or off by an on/off switch 26 best shown in FIG. 2.

One of the advantageous features of this invention is the incorporation of an antenna 28 which extends externally of the shell parts 12,12. Thus, a signal from remote control unit 30 is readily received by antenna 28 without having to pass through the shell structure itself. As a result, the range of effectiveness for device 10 is dramatically increased to at least 50 feet and can be as great as 65 feet, in striking contrast to the conventional range of effectiveness of only 15–20 feet.

Figure 1:
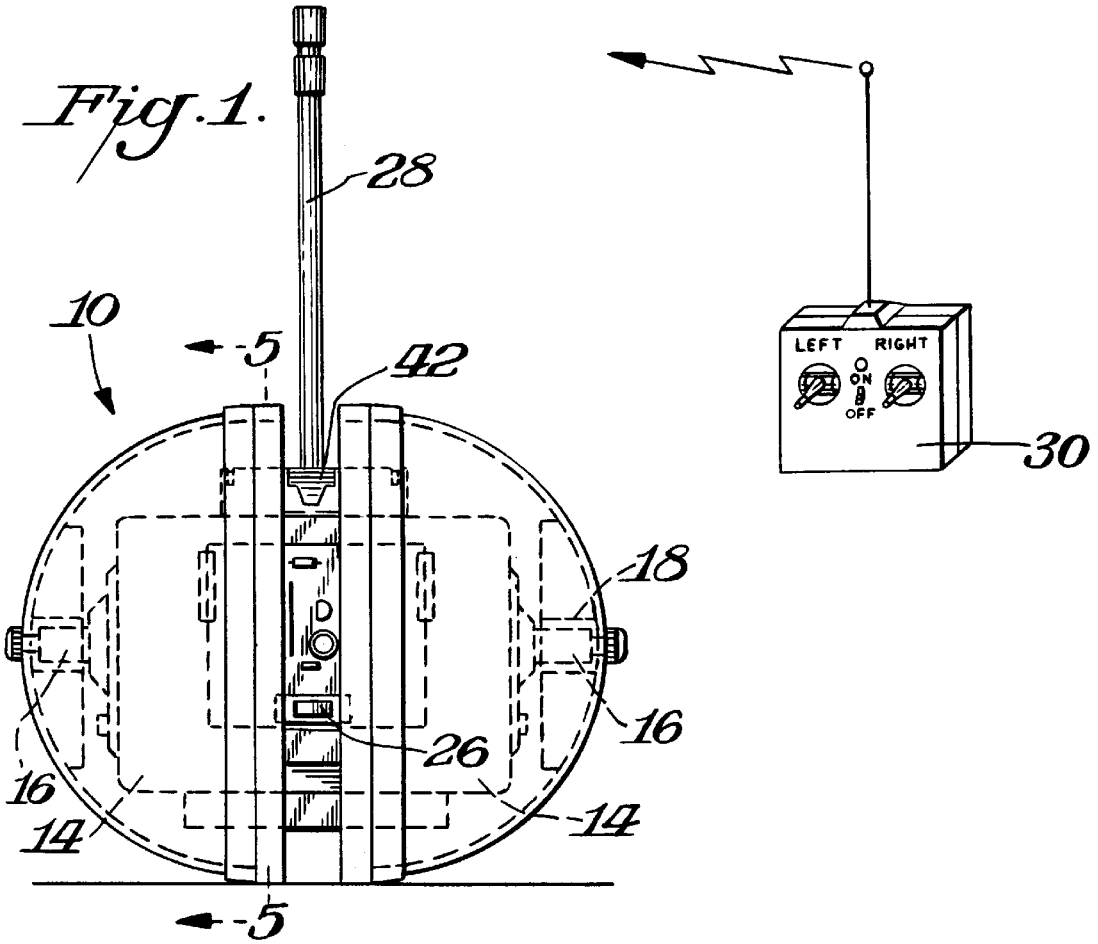
FIG. 1 is a side elevational view of a remote control movable ball amusement device in accordance with this invention.

The remote control radio wave unit or transmitter 30 is illustrated in FIG. 1 as having separate controls for the two shell parts 12,12 with each control being identified by the term left or right. Preferably each control is an on/off switch shown for activating or inactivating the individual drive units for each left and right shell. The activation of a particular control stick would send a signal characteristic for the particular drive mechanism 14 so that the same antenna 28 could receive signals from the same transmitter and yet operate the two separate drive mechanisms.

For remote control through electrical wiring operation, the wire/tether line would exit the device at the wheely bar antenna tip and attach to the remote control box (hand held). This method keeps the wire/tether line free from tangles.

As used herein the term remote control is intended to refer to a remotely located control unit which can operate by transmitting radio waves or through an electrical wire/tether line.

One of the distinct advantages of the present invention is the ability to control movement of the device. For example, with reference to FIG. 1, the control unit 30 provides the ability to control the movement of the device 10 by the selective movement of the right and left control sticks. Device 10 can, for example, be moved at rapid speed in a forward direction by simultaneously moving each of the left and right hand control members at full throttle in a forward direction. Conversely, a. rapid backward movement could be achieved by simultaneously moving each control member in a reverse direction at full throttle. Device 10 can be turned to the left by applying more power with the right control member than with the left control member and conversely can be turned to the right by applying more power with the left control member than with the right control member. Device 10 could be made to spin by simultaneously applying the same amount of power to each control member, but with one control member in a forward direction and the other control member in a reverse direction. The direction of spin as to clockwise or counter-clockwise would be determined in accordance with which control member is moved forward and which is moved in reverse. Device 10 could be made to change its direction of movement by combining first a turn movement to change the orientation of device 10 and then using the controls for forward or reverse movements.

Figure 3:
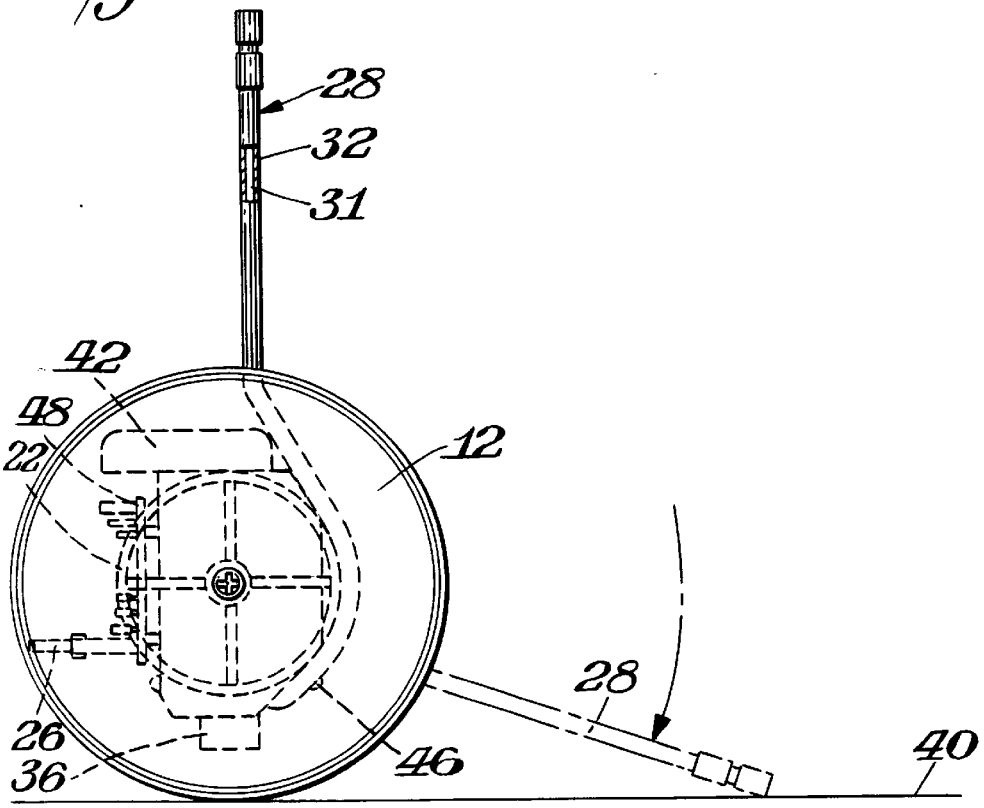
FIG. 3 is an end elevational view of the device shown in FIGS. 1–2.
Figure 4:
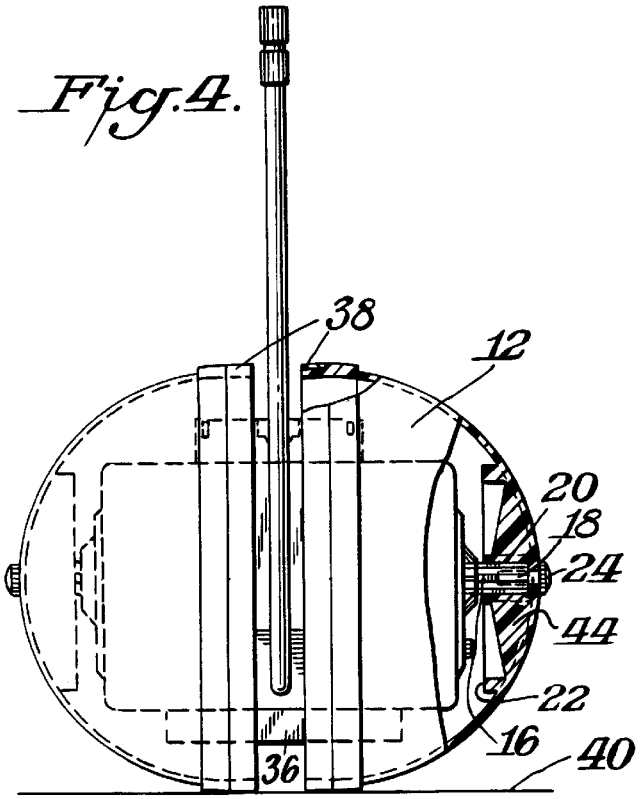
FIG. 4 is a rear elevational view, partly broken away and in section of the device shown in FIGS. 1–3.
Figure 5:
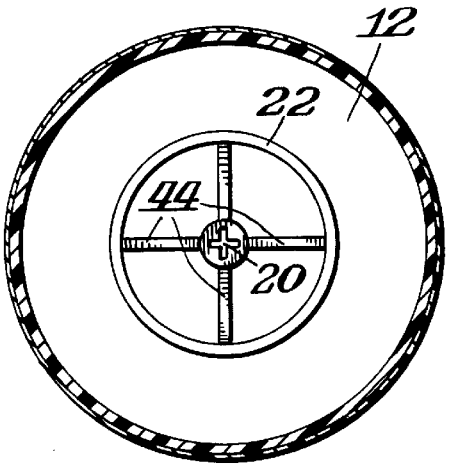
FIG. 5 is a cross-sectional view taken through FIG. 1 along the line 5—5.

Antenna 28 is preferably made of a metal rod 30 covered by a polycarbonate layer 32 as shown in FIG. 3. Antenna 28 functions not only to increase the range of effectiveness of the remote unit but also to act as a wheely bar which prevents the internal mechanism from spinning inside the shell parts 12,12 In normal operations wheely bar antenna 28 would be in a vertical or in a backwards trailing position. This central vertical position is enhanced by providing a weight 36 near the bottom of device 10 centrally in the shell parts and more particularly located at the juncture of the shell parts so as to counter torque-which might cause spinning. The weight 36 lowers the center of gravity to the lower-portion of device 10. If there should be any turning or spinning of the ball to cause antenna 28 to move from its vertical position, the antenna acts as a stop to limit such turning as illustrated in phantom in FIG. 3. The weight 36 would then cause antenna 28 to return immediately to its vertical position. Thus, the weight 36 acts as biasing structure to urge the antenna 28 to remain vertical during movement of the ball. Where, however, both shells move in the same direction at a fast and/or continuous speed then the normal position of the wheely bar antenna 28 is to be trailing and in contact with the floor 40 such as shown in phantom in FIG. 3 and also in FIG. 10. Thus, if the device 10 is moved at intermittent and/or slow speed the antenna 28 would tend to move toward a vertical orientation and if the device 10 turns or spins the wheely-bar antenna 28 would tend to be vertical.

The use of a wheely bar antenna is particularly desirable where the device 10 is of small size. For example, a six inch diameter ball might include a six ounce weight 36. With such small device 10 the mechanism would occupy substantially the entire interior of the device and a wheely bar antenna 28 would be particularly desirable. Where, however, a larger device 10, such as a twelve inch diameter ball is used having a wheely bar is not as critical. In such larger device the weight which could be from three ounces to six ounces should be great enough to resist the tendency of the torque to flip the device around. Where the device is used with both shells moving in the same direction at fast and/or continuous speed it is desirable to have a wheely bar antenna which trails the device and contacts the support surface or floor to keep the center from spinning.

As previously noted where a small size, such as a six inch diameter ball is used the provision of a wheely bar antenna is crucial to its operation. There would be no forward or reverse movement at high speed if the wheely bar antenna 28 does not trail in a direction opposite that of the direction of travel. In such position, the wheely bar antenna prevents spinning of the mechanism in such small balls. The provision of a wheely bar antenna is particularly necessary in small devices where so much of the interior is taken with the drive mechanism that sufficient space is not readily available to provide counter weights. With a larger device such as a 12 inch ball it is not as necessary to have the wheely bar function since the weight 36 could prevent spinning of the internal mechanism. However, in extreme climbing conditions, the wheely bar antenna would help the larger ball and of course act as a vertical antenna.

It is to be understood that the provision of a weight such as weight 36 to lower the center of gravity and the provision of a wheely bar antenna are features which may be used in combination or as alternatives to each other.

Any suitable material may be used for the shell parts 12,12. Preferably, a lexan material is used. Similarly, any suitable power source may be used for drive mechanisms 14,14. Preferably, a six volt nickel-cadmium battery is used or a four AA battery tray 42 may be used.

In order to provide traction for the shell parts 12,12 tires or traction bands 38 (FIG. 4) are located at each end of each shell part 12 at the juncture of the shell parts. Reference is again made to U.S. Pat. No. 5,439,408 which discloses various traction materials. As is apparent from FIGS. 1 and 4 the traction materials contact the support surface or floor 40 and elevate the shell parts themselves above the floor 40.

FIG. 3 illustrates various components of the device 10 such as the battery pack or tray 42. The reinforcing ring or inner structure 22 is also shown as well as being shown in FIGS. 4 and 5. As shown therein the reinforcing ring 22 includes a plurality of ribs 44. The antenna 28 is shown as being in contact with and mounted to the motor housing by means of fastener 46 in FIG. 3. A common motor housing would be used for both drive mechanisms 14,14. FIG. 3 also illustrates a printed circuit board 48 for the electronics involved with the drive mechanisms.

The shell parts 12,12 are preferably spaced apart so as to provide ready access to switch 26 and to facilitate antenna 28 extending through the juncture between the shell parts. Any suitable spacing may be used including closing the juncture by a rolling seal through which the antenna could extend. The spacing may, for example, be about ⅛ inch.

Preferably a single antenna is used to power both drive mechanisms 14,14. If desired, a separate antenna may be used for each drive mechanism.

Figure 6:
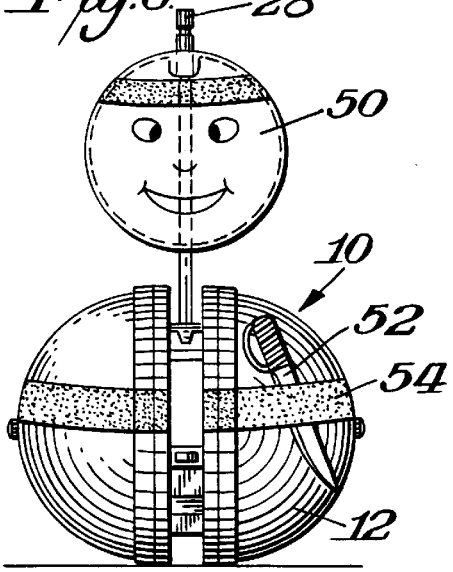
FIG. 6 is a front elevational view of a modified form of remote control movable ball amusement device in accordance with this invention.

FIG. 6 illustrates a variation of the invention wherein the device 10 is modified to simulate an object by having caricature structure on the device. To accomplish this the antenna 28 advantageously functions as a support for an object 50 such as a simulated head 50. The antenna is still at least partially exposed to effectively receive signals from the remote unit 30. Where the antenna 28 is used to hold a simulated head, the shell parts may simulate the body of a caricature such as a sumo wrestler. Where a simulated head 50, such as a sumo wrestler would be mounted on antenna 28 the antenna and axial opening of the simulated head would include complementary engaging structure to mount the simulated head spaced above the shell parts 12 and yet not interfere with the ability of the antenna to receive signals.

The theme of the caricature could be carried out by other simulated structure on the device 10. FIG. 6, for example, also illustrates a simulated sword 52 held in a band 54 on a shell part 12.

Figure 7:
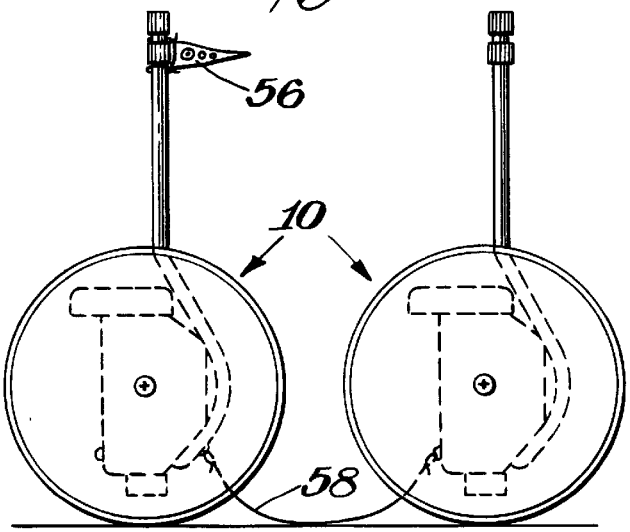
FIG. 7 is an elevational view showing a combination of remote controlled movable ball amusement devices in accordance with this invention.

The antenna could also be used as a mast for an object such as a flag 56 as shown in FIG. 7. The object 56 could be a banner, sign or any other decoration or identification.

FIG. 7 further illustrates the possibility of physically joining a pair of devices 10,10 by any suitable connecting member such as cord 58. In such practice of the invention there would be two participants, each controlling as separate device 10 in some form of game.

Figure 8:
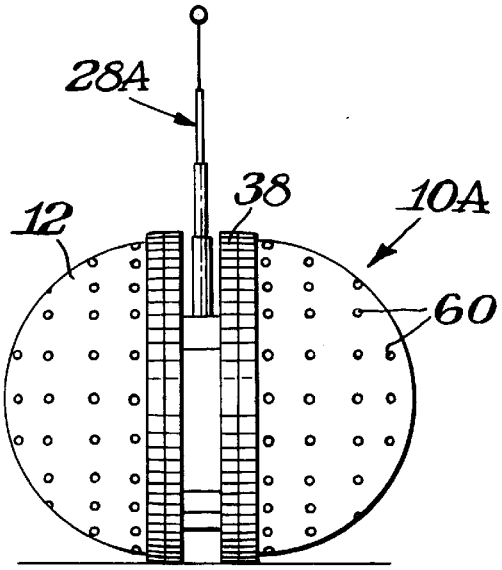
FIGS. 8–13 are side elevational views similar to FIG. 1 of modified forms of remote control movable ball amusement devices in accordance with this invention.

FIG. 8 illustrates a variation of the invention wherein the antenna 28A is of telescopic construction so that it can be adjusted in length including being contracted to a size so as to be totally within the device 10A. An alternative would be to completely omit an externally extending antenna and use an antenna which is internally mounted in the device in a conventional manner or to use any type of internal receiver. FIG. 8 shows that under such practice where there is no external antenna, the shell parts 12,12 would include a pattern or plurality of holes 60 extending completely through the shell part to provide a clearer passage for the radio signal directly to the internal antenna or receiver. The provision of the holes 60 would also increase the range of effectiveness of the remote unit over that conventionally achieved.

Figure 9:
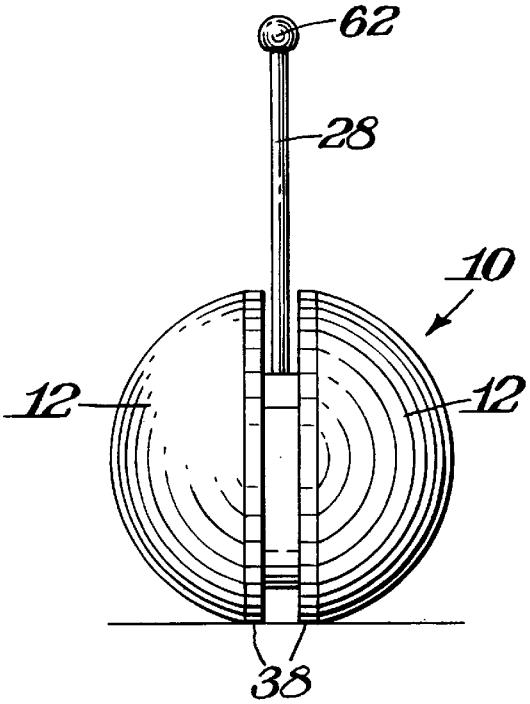

FIG. 9 illustrates a variation of the invention wherein the device 10 includes a ball shaped protective tip 62 for antenna 28. Device 10 shown in FIG. 9 is also in more of a true spherical form from the two segments 12,12 than in, for example, the embodiment of FIGS. 1–5. In the embodiment of FIG. 9 the edges of the shell parts 12,12 would still terminate in a flat traction material 38.

Figure 10:
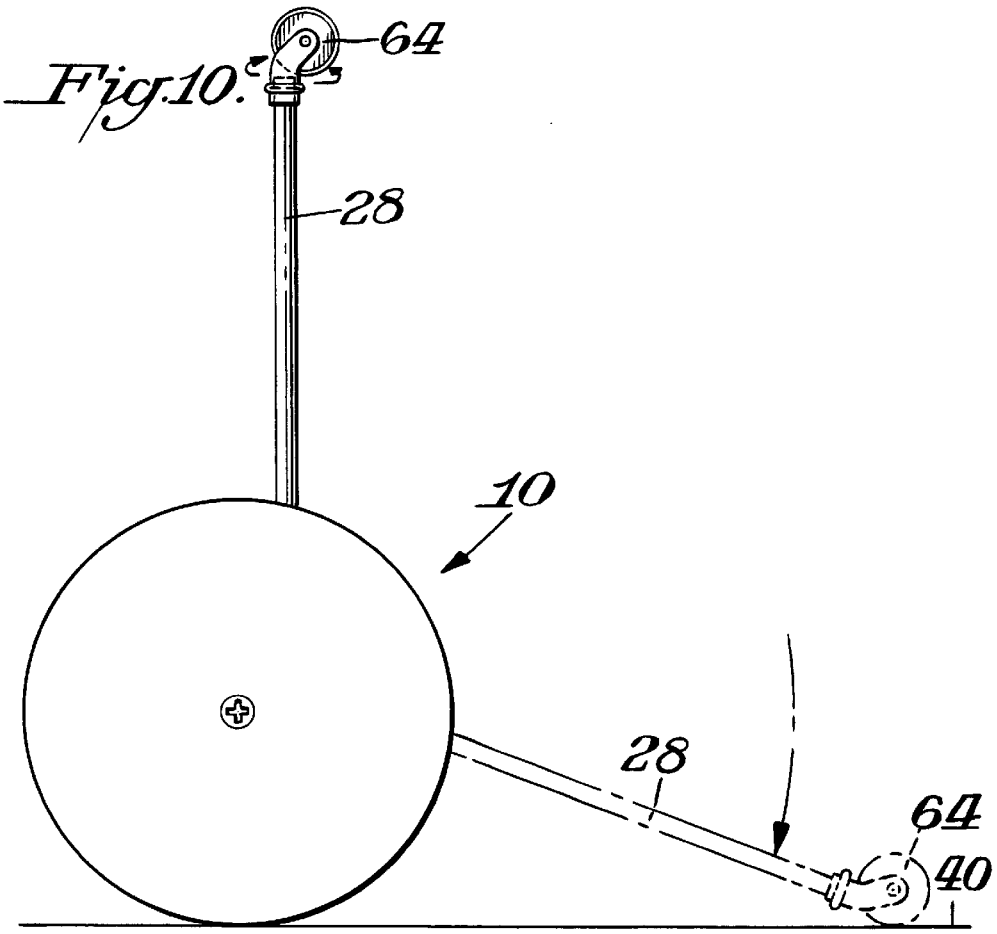

FIG. 10 illustrates a further variation of the invention wherein the antenna 28 is provided with a small rotating wheel 64 at its upper end. Wheel 64 which can also swivel, would make contact with the floor 40 as shown in phantom. As a result, there would be less friction on the antenna 28 touching the floor. This would not only prevent wear and tear of the device but would also provide safety features. If, for example, the antenna directly touched the floor, over a period of time a point would tend to be created which could present injury problems to a user. By having a reduced friction from the rolling wheel 64 the speed of the device 10 is also in enhanced.

Figure 11:
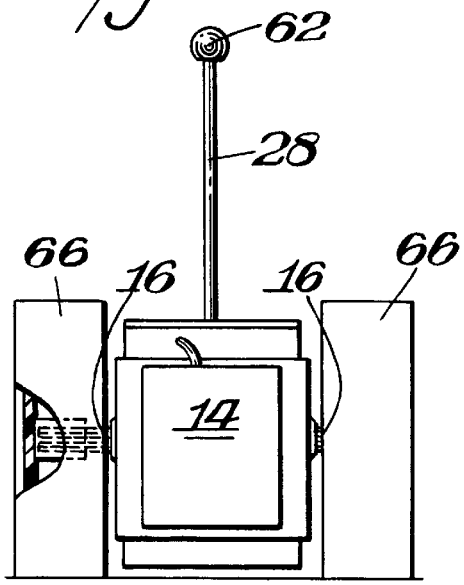

FIG. 11 shows a variation of the invention which makes a dramatic departure from a pure ball structure. Because it includes rolling surfaces, the device is still considered ball-like. As shown therein the same internal drive mechanisms 14,14 as illustrated for example in FIGS. 1–5 would be used. Instead of having a pair of hemispherical shells attached to each shaft 16,16, however, any other type of structure could be mounted on the shaft. In the embodiment shown in FIG. 11 a pair of tire type structures 66,66 are shown with each tire mounted to a respective shaft. The tires would individually rotate independently of each other in the same manner as the shells 12,12. The same concepts could be used where the rotating members 66,66 form parts of other types of simulated devices such as a track of a tank. In such embodiments, the portions between the rotating devices would include simulated structure representative of the specific object such as a tank or tractor.

Figure 12:
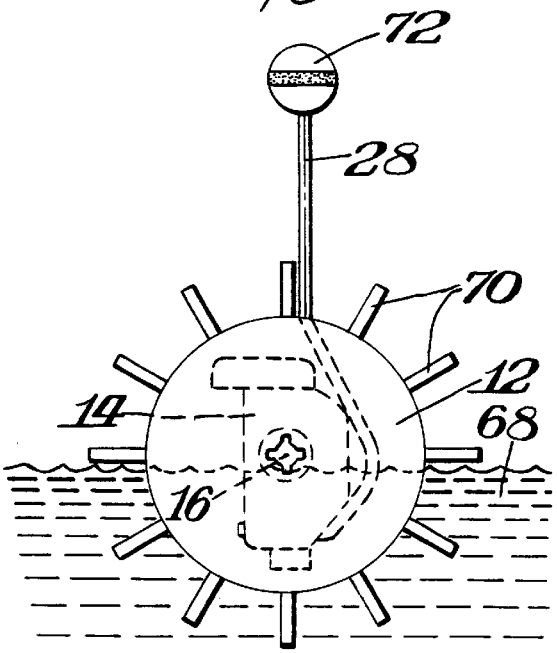

FIG. 12 illustrates yet another version of the device wherein the device is sealed and buoyant and is thus floatable in water 68. Each shell 12 may be provided with paddles circumferentially aligned 70 at its edge so that the rotating shells 12,12 cause the paddles to move through the water. As shown in FIG. 12 a buoyant foam ball 72 is secured to the top of antenna 28 to minimize any tendency for the antenna to rotate below the surface of the water.

In the various embodiments such as shown in FIGS. 11–12 the power unit which includes drive mechanisms 14 with their rotatable shafts 16 could form a separate power unit that could be secured to different external rotating structures such as the tires 66 or the shells having paddles 70, in addition to the more basic units such as illustrated in FIGS. 1–5.

Figure 13:
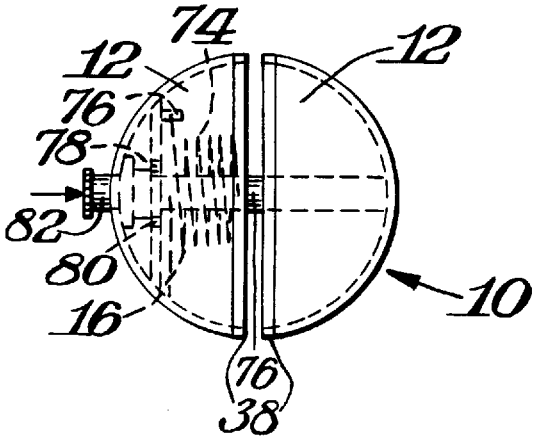

Various devices which have been illustrated in FIGS. 1–12 include a motor drive mechanism to provide the power. FIG. 13 illustrates a variation of the invention which omits a motor drive and provides more of a random type movement instead of the controlled movement in the motor driven embodiments. As shown in FIG. 13 each shell 12 includes a manual type drive mechanism which is in the form of a wind up spring 74 secured at one end 76 to a shaft 16 with the aligned shafts 16 being mounted in any suitable manner so as to permit independent movement. The opposite end 76 of each spring 74 is secured to a fixed post within its shell. Shaft 16 could include a series of ratchet teeth 78 which engage a circular rack 80 mounted within shell 12. A actuating member or button 82 could be provided to wind the shaft by having the rotating teeth in continuous engagement with the rack thereby locking the shaft against rotation in the unwinding direction. After either or both of the springs 74 have been wound, the actuating member 82 is pushed inwardly to disengage the teeth and rack and thereby permit the shaft to freely rotate under the influence of spring 74 unwinding. The result is a random type movement of the device. To again use the device the actuating member 82 would be pulled outwardly to engage the teeth in the rack and the spring 74 would again be wound. Preferably, the device of FIG. 13 is of generally tennis ball size and shape. Such version of the device as in FIG. 13 eliminates the need for power operation but does not provide the same control as with the earlier versions. Instead, the amusement value is from the random type behavior of the device.

The device 10 of this invention represents a marked improvement over conventional remote control balls. For example, by having multiple drive units the speed of the device can be increased as well as enhancing directional control. The device can literally stop on a dime. Where, for example, there is great forward torque by having both shell parts 12,12 move in the same forward direction, contact of the antenna on the floor causes the device to jump like a rabbit.

As noted, the antenna has a number of functions. Not only does it increase the range of effectiveness of the device, but the antenna also acts as a support for various objects such as a simulated head 50 or flag 56.

The multiple advantages of the antenna can be utilized with a ball closer to conventional construction such as a completely spherical ball having a single drive mechanism.

It is to be understood that various features of any embodiment may be used in other embodiments within the spirit of this invention.

What is claimed is:

1. A movable ball-type amusement device comprising a plurality of shell parts mounted together to generally form a ball, connecting structure securing said shell parts together for independent movement of said shell parts with respect to each other, a separate drive mechanism connected to said shell parts for causing said shell parts to move independently of each other upon actuation of said drive mechanisms, each of said shell parts being of arcuate shape having an outer surface which is curved in more than one plane, and said arcuate outer surfaces of said shell parts in combination with each other forming a generally closed arcuate structure which allows sidewards rolling of said device selectively on a single one of said shell parts.

2. The device of claim 1 wherein said ball is non-spherical.

3. The device of claim 1 including an antenna operatively connected to said drive mechanisms and extending externally out of said non-spherical ball in a vertical direction for receiving a signal from a remote control unit.

4. The device of claim 3 wherein each of said shell parts terminates in a circumferential edge, said circumferential edges disposed toward and spaced apart from each other to create a spacing between said edges, and said antenna extending through said spacing.

5. The device of claim 4 wherein a weight mechanism is mounted in said ball to locate the center of gravity of said device in the lower half of said ball and at said spacing.

6. The device of claim 5 including an on/off switch mounted in said spacing for said drive mechanisms for selectively turning said drive mechanisms on and off.

7. The device of claim 4 wherein each of said drive mechanisms includes a reversible motor having a shaft extending outwardly therefrom, said shafts being coaxially aligned with each other to form a horizontal axis, said motors being mounted to a common housing, and said motors causing said shell parts to rotate about said horizontal axis.

8. The device of claim 7 wherein each of said shafts is mounted to a respective one of said shell parts at diametrically aligned locations.

9. The device of claim 4 wherein traction bands are mounted at said edges, and said traction bands comprising a generally flat contact surface.

10. The device of claim 3 including a common remote control unit having separate controls for each of said drive mechanisms with said antenna functioning as a common receiver for radio waves from said control unit to actuate each of said drive mechanisms.

11. The device of claim 3 wherein said antenna functions as a support having an object mounted to said antenna.

12. The device of claim 11 wherein said object is a flag.

13. The device of claim 11 wherein said object is part of a caricature.

14. The device of claim 11 wherein said object is a rotatable swivel wheel mounted to the outer end of said antenna.

15. The device of claim 1 wherein each of said shell parts is hemispherical.

16. The device of claim 1 wherein said device is buoyant, and paddles secured to and extending outwardly from said shell parts.

17. The device of claim 1 wherein said drive mechanism includes a spring manually windable about a shaft secured to said shell part.

18. The device of claim 1 including a plurality of holes extending completely through each of said shell parts to provide an open path for a signal sent by a remote control unit to a receiving in the interior of said ball.

19. The device of claim 18 wherein said receiver includes an antenna mounted totally internally of said ball.

20. The device of claim 1 wherein said ball is spherical.

21. The device of claim 1 in combination with a second one of said devices tethered to said device.

22. The device of claim 1 wherein each of said drive mechanisms includes its own motor.

23. The device of claim 22 wherein each of said motors is a reversible motor.

24. The device of claim 1 wherein said shell parts terminate in circumferential edges connected together by a joint which permits said shell parts to rotate independently of each other.

25. A movable rolling amusement device comprising a plurality of shell parts mounted together to form a generally closed structure, a separate drive mechanism disposed within each of said shell parts, a rotatable shaft driven by each of said drive mechanisms, each of said shafts being connected to a respective one of said shell parts for causing said shell parts to move independently of each other upon actuation of said drive mechanisms, each drive mechanism being controlled by signals from a remote control unit, a wheely bar located in said device midway between said shell parts and extending outwardly of and beyond the outer surface of said shell parts, said wheely bar being connected to said drive mechanisms and being rotatable between a vertical position and a downwardly inclined trailing position, said wheely bar comprising means to prevent said drive mechanisms from spinning inside said shell parts, said wheely bar further comprising an antenna for receiving the signals for said drive mechanisms, and said antenna being the outermost portion of said device to assure reception of the signals with minimal interference to maximize the range of effectiveness of the signals from the remote control unit.

26. The device of claim 25 wherein said combined structure is a non-spherical ball.

27. The device of claim 25 wherein each of said shell parts terminates in a circumferential edge, said circumferential edges disposed toward and spaced apart from each other to create a spacing between said edges, and said antenna extending through said spacing.

28. The device of claim 27 wherein a weight mechanism is mounted in said structure to locate the center of gravity of said device in the lower half of said structure and at said spacing.

29. The device of claim 28 including an on/off switch mounted in said spacing for said drive mechanisms for selectively turning said drive mechanisms on and off.

30. The device of claim 27 wherein each of said drive mechanisms includes a reversible motor having said shaft extending outwardly therefrom, said shafts being coaxially aligned with each other to form a horizontal axis, said motors being mounted to a common housing, and said motors causing said shell parts to reversibly rotate about said horizontal axis.

31. The device of claim 30 wherein each of said shafts is mounted to a respective one of said shell parts at diametrically aligned locations.

32. The device of claim 27 wherein traction bands are mounted at said edges, and said traction bands comprising a generally flat contact surface.

33. The device of claim 27 wherein each of said shell parts is hemispherical.

34. The device of claim 25 wherein said antenna functions to receive radio signals and as a support having an object mounted to said antenna.

35. The device of claim 34 wherein said object is a flag.

36. The device of claim 34 wherein said object is part of a caricature.

37. The device of claim 34 wherein said object is a rotatable swivel wheel mounted to the outer end of said antenna.

38. The device of claim 25 wherein said device is buoyant, and paddles secured to and extending outwardly from said shell parts.

39. The device of claim 25 in combination with a second one of said devices tethered to said device.

40. The device of claim 25 wherein each of said drive mechanisms has its own motor.

* * * * *